US006973882B2

(12) United States Patent
Baechle et al.

(10) Patent No.: US 6,973,882 B2
(45) Date of Patent: Dec. 13, 2005

(54) SINGLE USE DISPOSABLE PALLET

(75) Inventors: James Baechle, Hendersonville, TN (US); Stephen Brown, East Lansing, MI (US)

(73) Assignee: Sonoco Development, Inc., Hartsville, SC (US)

( * ) Notice: Subject to any disclaimer, the term of this patent is extended or adjusted under 35 U.S.C. 154(b) by 117 days.

(21) Appl. No.: 10/707,303

(22) Filed: Dec. 4, 2003

(65) Prior Publication Data

US 2005/0120921 A1 Jun. 9, 2005

(51) Int. Cl.[7] ..... B65D 19/00
(52) U.S. Cl. ..... 108/51.3; 108/56.3
(58) Field of Search ..... 108/51.3, 51.11, 108/55.5, 56.3; 248/346.02; 206/386, 599, 206/600

(56) References Cited

U.S. PATENT DOCUMENTS

| | | | | | |
|---|---|---|---|---|---|
| 2,692,747 | A | * | 10/1954 | Strauss | 108/51.3 |
| 2,997,266 | A | * | 8/1961 | Munroe | 108/51.3 |
| 3,131,656 | A | * | 5/1964 | Houle | 108/51.3 |
| 3,308,772 | A | * | 3/1967 | Thomas, Jr. | 108/51.3 |
| 3,763,791 | A | * | 10/1973 | Wilcox, Jr. | 108/51.3 |
| 4,703,702 | A | * | 11/1987 | Speicher | 108/56.3 |
| 4,831,938 | A | | 5/1989 | Atterby et al. | |
| 5,176,090 | A | * | 1/1993 | Roberts et al. | 108/51.3 |
| RE34,198 | E | | 3/1993 | Quasnick | |
| 5,195,440 | A | * | 3/1993 | Gottlieb | 108/51.3 |
| 5,285,731 | A | | 2/1994 | McIntyre | |
| 5,329,861 | A | | 7/1994 | McCarthy | |
| 5,377,600 | A | | 1/1995 | Speese et al. | |
| 5,503,085 | A | * | 4/1996 | Rozek | 108/51.3 |
| 5,528,995 | A | * | 6/1996 | Lim | 108/56.1 |
| 5,595,125 | A | | 1/1997 | Bridges, Jr. | |
| 5,660,119 | A | * | 8/1997 | Perkins | 108/51.3 |
| 5,890,437 | A | * | 4/1999 | Hill | 108/51.3 |
| 5,909,712 | A | | 6/1999 | Tan | |
| 5,921,187 | A | | 7/1999 | Wang | |
| 6,041,029 | A | * | 3/2000 | Iida et al. | 369/47.18 |
| 6,173,658 | B1 | | 1/2001 | Moberg | |
| 6,357,364 | B1 | | 3/2002 | Maloney et al. | |
| 2002/0069796 | A1 | | 6/2002 | Olvey et al. | |

FOREIGN PATENT DOCUMENTS

| | | | |
|---|---|---|---|
| JP | 11029146 | A | 2/1999 |
| JP | 2001122264 | A | 5/2001 |
| WO | WO 98/18686 | | 5/1998 |

* cited by examiner

*Primary Examiner*—Jose V. Chen
(74) *Attorney, Agent, or Firm*—Clausen Miller, P.C.

(57) ABSTRACT

A single use disposable, recyclable paper pallet for supporting products during storage and shipping is provided. The pallet comprises a corrugated panel resting on multiple, parallel corrugated runners locked together by lateral supports. The runners are made from blanks folded into elongated open-ended box-like shapes. The folded runners have perforated tabs that extend upwards from the top surface of the runners and configured to receive the lateral supports. The lateral supports are formed from a sheet of convolutely wound, formed laminated paper and provide lateral strength so the pallet can be handled with a clamp truck.

15 Claims, 5 Drawing Sheets

SINGLE USE DISPOSABLE PALLET

BACKGROUND OF INVENTION

This patent relates to pallets used for supporting products during storage and shipping. More specifically, this patent relates to a single use disposable pallet that can be assembled without adhesive or tape and is capable of being handled with a forklift, pallet jack or clamp truck.

Pallets, sometimes referred to as carriers, skids or base pads, are used to support products during storage and shipping. Products are typically shipped on either traditional wooden pallets or paper-based pallets made of a combination of honeycomb and corrugated materials. Traditional wooden pallets are expensive and difficult to store and dispose of. Conventional paper-based pallets do not provide enough lateral strength to be clamp handled and usually require adhesive or tape to assemble. The present invention is intended to overcome these disadvantages and provide additional advantages as described herein.

SUMMARY OF INVENTION

The present invention is a single use disposable pallet for supporting products during storage and shipping. The pallet comprises a plurality of corrugated runners, a corrugated panel and lateral supports that interlock together. The corrugated runners are made from scored blanks that are folded into elongated open-ended box-like shapes. The folded runners have tabs that extend upwards from the top surface of the runners for insertion into slots in the corrugated panel. The lateral supports are inserted into openings in the upstanding tabs. Additional tabs located on either side of the pallet prevent the lateral supports from sliding out of the openings.

The lateral supports may be formed from sheets of laminated paperboard that has been convolutely wound and then formed into the desired shape. The lateral supports provide lateral strength so the pallet can be handled with a clamp truck.

The pallet may be made entirely of paper components and can be shipped broken down and assembled on site without adhesive or tape. Optional stretch wrap may be placed over the unit to protect the products from dust and dirt.

DETAILED DESCRIPTION

Figure 1:
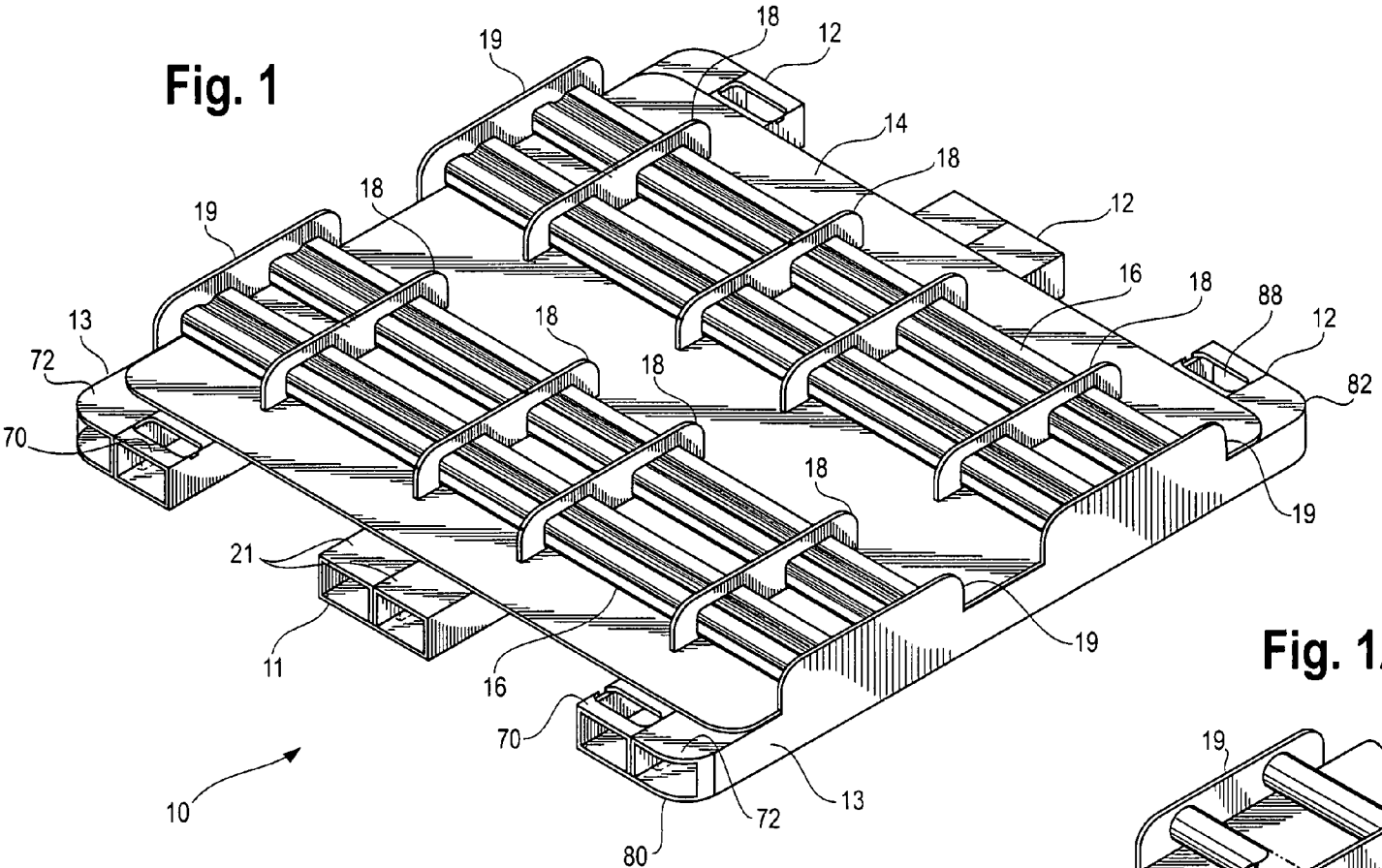
FIG. 1 is a perspective view of one embodiment of a pallet according to the present invention.

Turning to the drawings, there is shown in FIG. 1 a preferred embodiment of the invention, a single use disposable pallet 10 for use during the shipping, handling and displaying of products. The preferred embodiment 10 comprises three runners 12 (consisting of a middle runner 11 and two side runners 13), a flat deck member 14, and four lateral supports 16, all made of paper. The runners 12 and the deck member 14 are made of corrugated board and the supports are made of wound laminated paper as described further below. When assembled, the pallet 10 provides a platform for one or more products (such as plastic garden hose reels) to rest on and can be handled with either a forklift, pallet jack or clamp truck. Optional stretch wrap (not shown) may be placed over the unit to protect the products from dust and dirt.

The runners 12 are made from blanks of corrugated board that are folded into elongated open-ended box-like shapes. The flutes in the corrugated board preferably run longitudinally, that is, in the direction of the folds. The folded runners 12 have perforated tabs 18 integrally formed with the side panels 32, 66, 68 that extend above the load bearing top panels 21, 70, 72 of the runners 12. The perforations or openings 22 in the perforated tabs 18 are configured to receive the lateral supports 16 as described more fully below. Solid (non-perforated) tabs 19 located on either side of the pallet 10 prevent the lateral supports 16 from sliding laterally.

The runners 12 include two opposing side runners 13 located on either side of the pallet 10 and one or more middle runners 11 between and parallel to the side runners 13. The runners 12 lock in the support posts 16, provide vertical support for warehouse stacking, and provide clearance for fork lift capability.

Figure 3:
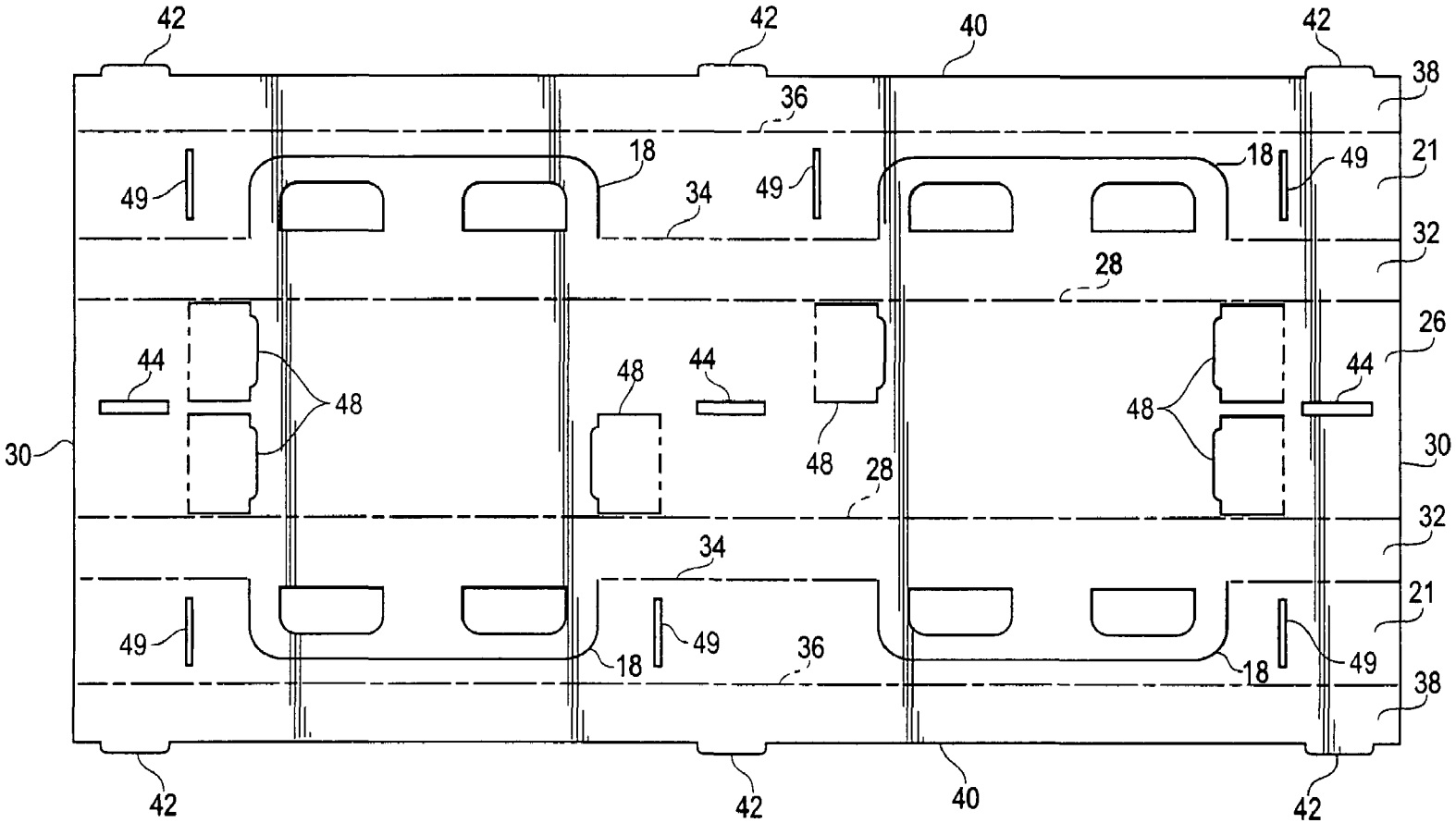
FIG. 3 is a plan view of a blank used in the manufacture of a middle runner of the pallet of FIG. 1.

FIG. 3 is a plan view of a blank 24 used in the construction of a middle runner 11. The blank 24 is generally rectangular and has opposing ends 30 and top and bottom edges 40. Pairs of fold lines 28, 34, 36 run parallel to the top and bottom edges 40. The blank 24 comprises a bottom panel 26 defined by fold lines 28 and opposing ends 30; two side panels 32, each defined by fold lines 28, 34 and opposing ends 30; a pair of top panels 21, each defined by fold lines 34, 36 and opposing ends 30; and a pair of center mating panels 38, each defined by a fold line 36, opposing ends 30 and either a top or bottom edge 40. A pair of perforated tabs 18 are die cut from each top panel 21 as shown. Locking tabs 42 extend from the top and bottom edges 40 of the blank 24 for insertion into slots 44 die cut in the bottom panel 26 when the blank 24 is folded to form the middle runner 11. Flaps 48 are cut from the bottom panel 26 and are used to help hold the assembled runner 11 rectangular as described below.

Figure 5:
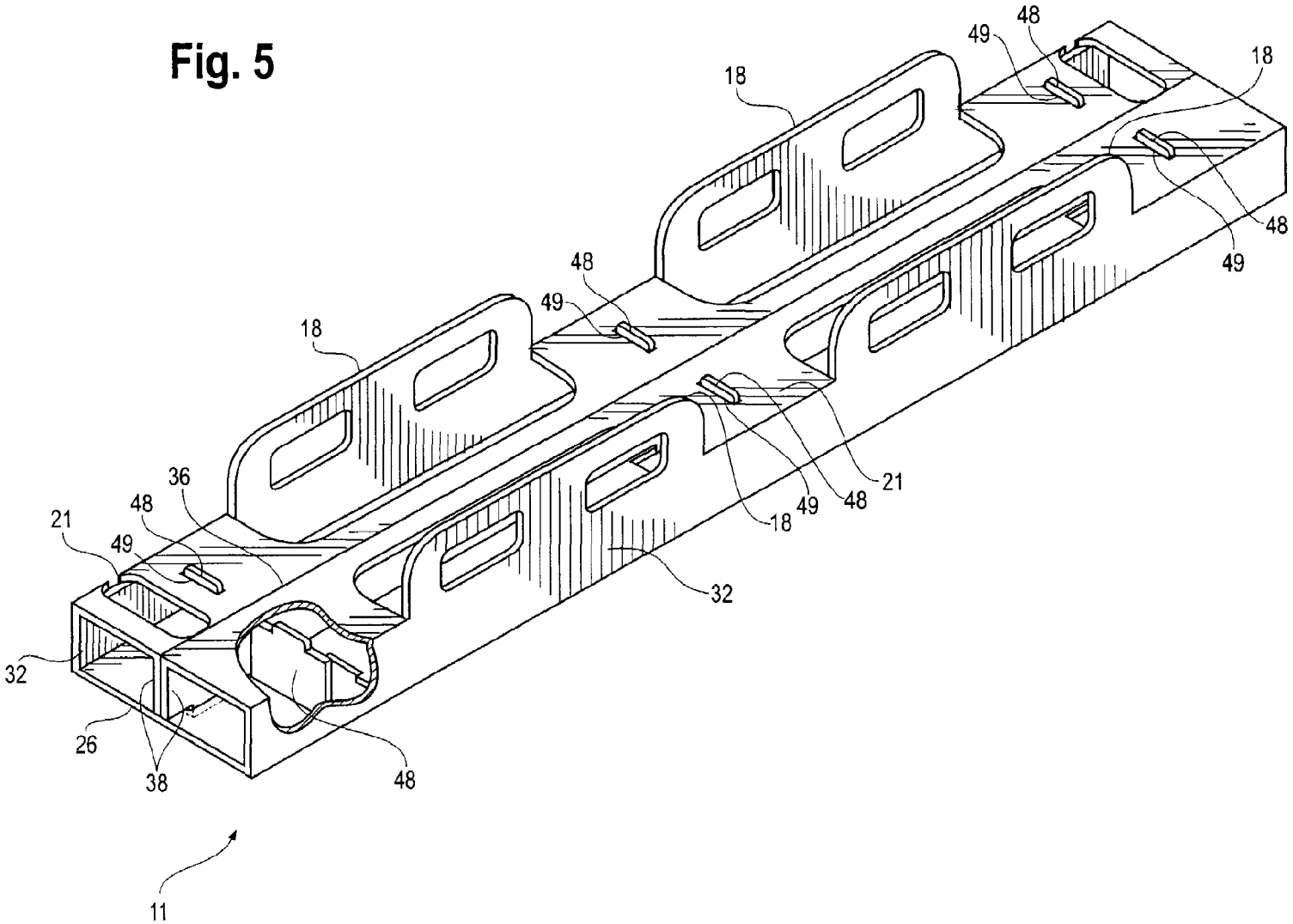
FIG. 5 is a perspective view of a middle runner of the pallet of FIG. 1.

FIG. 5 is a perspective view of a constructed middle runner 11 with a portion cut away to show additional interior structure. To construct the middle runner 11, the flaps 48 are folded into an upright, vertical position. The center mating panels 38 are brought together in adjacent, facing relationship by folding the blank 24 at the parallel fold lines 28, 34, 36 until the locking tabs 42 are inserted into the slots 44 (FIG. 3). Again referring to FIG. 5, as the center mating panels 38 are brought together, the tabs on top of the flaps 48 become inserted through the lateral slots 49 in the top panels 21, which keeps the flaps 48 vertical. The flaps 48 keep the runner 11 rectangular (prevent trapezoiding) and increase the vertical stacking strength of the runner 11.

In the constructed middle runner 11, the side panels 32 extend upward from and are disposed at right angles to the bottom panel 26, the top panels 21 extend inward from and are disposed at right angles to the side panels 32, and the center mating panels 38 extend downward from and are disposed at right angles to the top panels 21. The perforated tabs 18 extend upward from the side panels 32 above the plane defined by the top panels 21.

Figure 4:
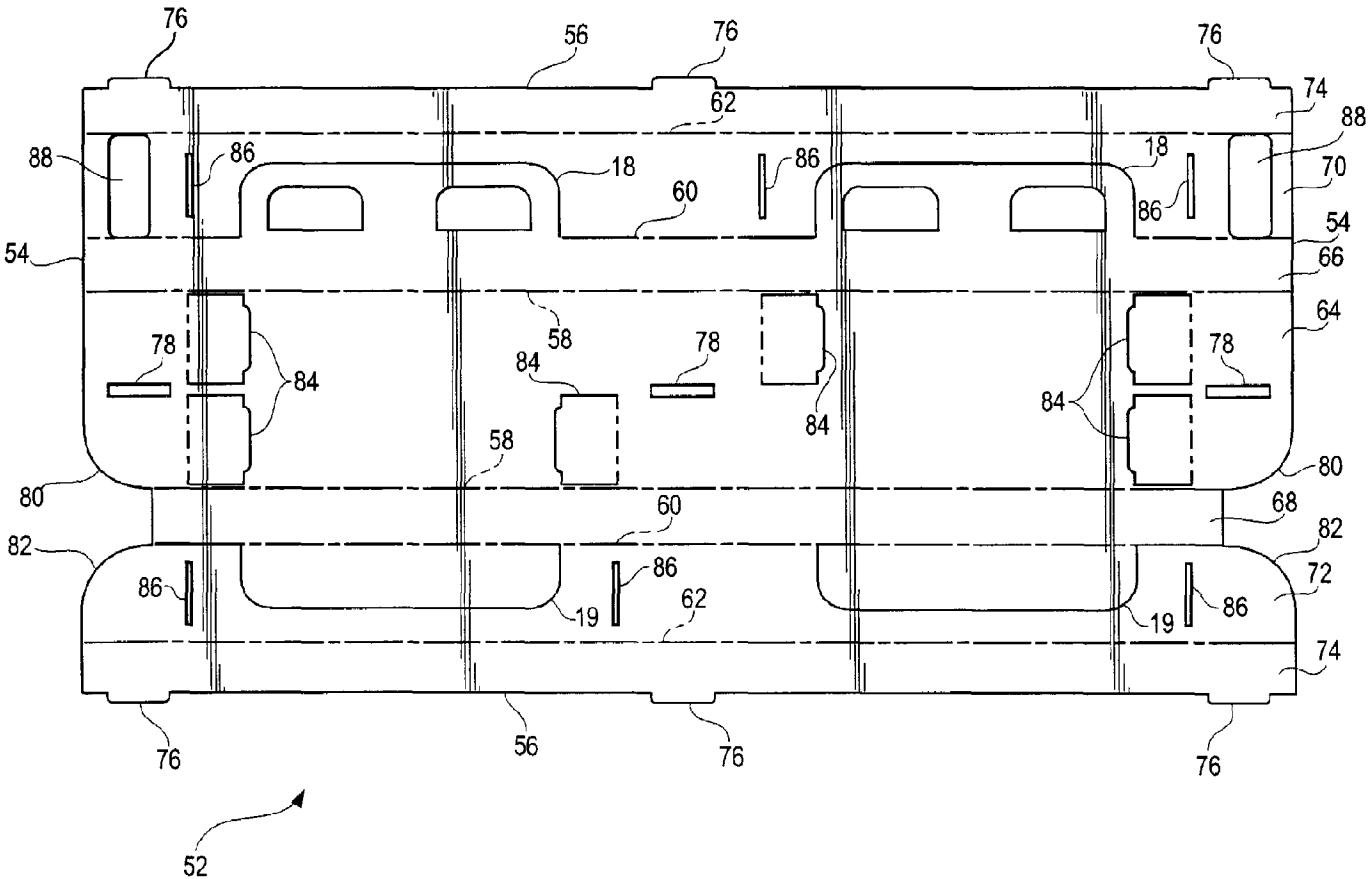
FIG. 4 is a plan view of a blank used in the manufacture of a side runner of the pallet of FIG. 1.

FIG. 4 is a plan view of a blank 52 used in the construction of a side runner 13. This blank 52 is also generally rectangular and is defined by opposing ends 54 and top and bottom edges 56. Pairs of fold lines 58, 60 and 62 extend parallel to the top and bottom edges 56. The blank 52 comprises a bottom panel 64 defined by parallel fold lines 58 and opposing ends 54; two side panels 66, 68, each defined by parallel fold lines 58, 60 and opposing ends 54; a pair of top panels 70, 72, each defined by parallel fold lines 60, 62 and opposing ends 54; and a pair of center mating panels 74, each defined by a fold line 62, opposing ends 54 and either a top or bottom edge 56. Perforated tabs 18 are die cut from the inner top panel 70 and solid tabs 19 are die cut from the outer top panel 72 so that they extend vertically upward above the top panels 70, 72 when the side runner 13 is constructed.

Locking tabs 76 extend from the top and bottom edges 56 of the blank 52 for insertion into slots 78 die cut in the bottom panel 64 when the blank 52 is folded to form a side runner 13. Flaps 84 are cut from the bottom panel 64 and are used to help hold the assembled runner 13 rectangular. Optional openings 88 may be cut into either end of the inner top panel 70 to accommodate vertical support posts.

Like the middle runner 11, the side runners 13 are constructed without the need for adhesive or tape. To construct a side runner 13, the flaps 84 are folded upright into a vertical position. The center mating panels 74 and 76 are brought together in facing relationship by folding the blank 52 at the parallel fold lines 58, 60 and 62 and the locking tabs 76 are inserted into the slots 78. As the center mating panels 74 are brought together, tabs on top of the flaps 84 become inserted through lateral slots 86 in the top panels 70, 72, which keeps the flaps 84 vertical. The flaps 84 keep the runner 13 rectangular (to prevent trapezoiding) and increase the vertical stacking strength of the runner 13.

Figure 2:
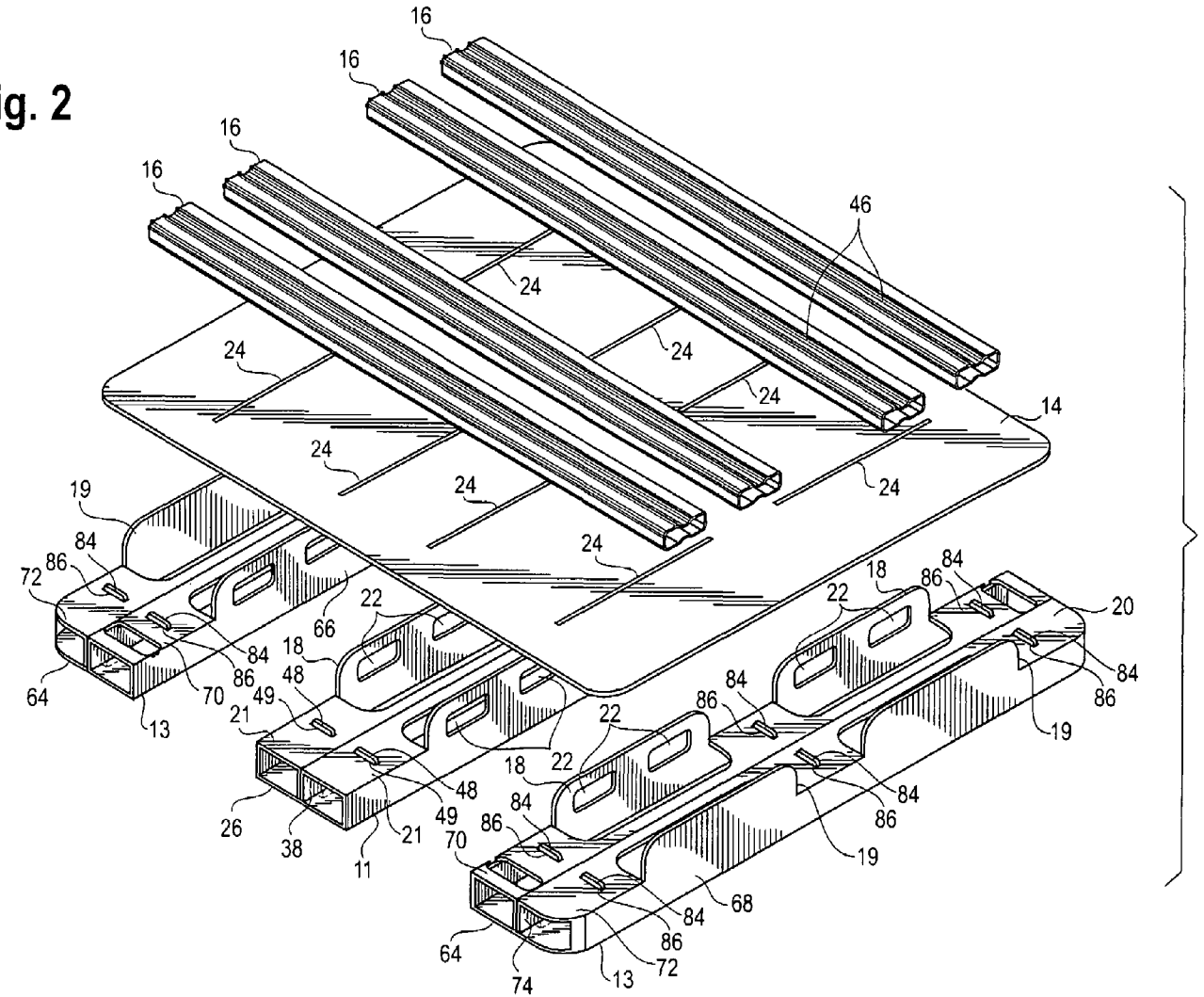
FIG. 2 is an exploded view of the pallet of FIG. 1.

In the constructed runner 13 the perforated tabs 18 and the solid tabs 19 extend upward as shown in FIGS. 1 and 2. The side panels 66, 68 extend upward from and are disposed at right angles to the bottom panel 64, the inner and outer top panels 70, 72 extend inward from and are disposed at right angles to the side panels 66, 68, and the center mating panels 74 extend downward from and are disposed at right angles to the top panels 70, 72. The perforated and solid tabs 18, 19 extend upward from the side panels 66, 68 above the top panels 70, 72, as shown in FIGS. 1 and 2. Opposing end portions 80 of the bottom panel 64 and opposing portions 82 of the outer top panel 72 are rounded so that the assembled side runner 13, and therefore pallet 10, has rounded corners, which prevents any stretch wrap that is used from tearing.

In both the middle runners 11 and side runners 13 the lateral supports 16 help keep the products from moving fore and aft while the tabs 18, 19 help keep the products from shifting side to side.

In the preferred embodiment each perforated tab 18 has two openings 22 for receiving a pair of lateral supports 16. However, other arrangements are possible including, without limitation, perforated tabs having a single opening or more than two openings. Likewise, the number and location of flaps 48, 84 in the middle runners 11 and in the side runners 13 may be varied as desired. Furthermore, the runners 12 need not be hollow rectangular structures, but could be other structures having upwardly extending perforated tabs for receiving the lateral supports 16 in interlocking fashion.

As best shown in FIG. 2, the deck member 14 is substantially planar and has a number of parallel slits 24 formed therein. The slits 24 are arranged so that, when the pallet 10 is assembled, the perforated tabs 18 (but not the solid tabs 19) fit through the slits 24 in the deck member 14, thereby locking the runners 12 in fixed parallel relationship to each other. Preferably, the deck member 14 is made from corrugated paperboard having flutes that run lengthwise, that is, parallel to the runners 11 and 13, for better edge strength on the front and rear edges. In the assembled pallet 10, the deck member 14 rests on the top panels 21, 70, 72 of the runners 12 between the upwardly extending solid tabs 19 of the side runners 13. Preferably the depth (front to back) of the deck member 14 does not exceed the length of the runners 12.

Figure 1A:
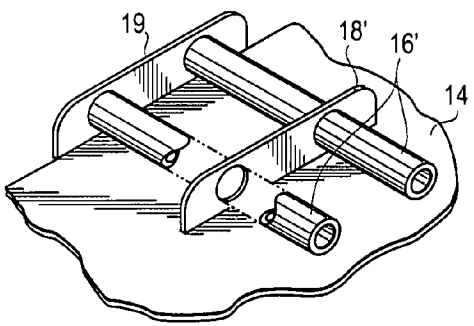
FIG. 1A is a partial perspective view of a second embodiment of the present invention.

The lateral supports 16 may be of the type manufactured by Sonoco Products Company of Hartsville, S.C. and described in U.S. Pat. Nos. 4,482,054; 5,593,039; 6,059,104 and 6,186,329, incorporated herein by reference. Each lateral support 16 may be formed from a sheet of laminated paperboard that has been convolutely wound and formed into the desired tubular shape. As best shown in FIG. 2, each support 16 has a substantially rectangular cross-sectional profile. In the illustrated embodiment, a pair of opposing beads 46 is integrally formed in the upper and lower surfaces of the support 16 for added strength and stiffness. It should be noted, however, that the supports 16 may be any suitable configuration, including configurations having a circular or triangular cross-sectional profile. For example, FIG. 1A is a partial perspective view of a pallet in which circular supports 16' are inserted through perforated tabs 18'. The supports 16, 16' provide lateral strength so the pallet 10 can be handled with a clamp truck and help distribute the product weight to the corrugated runners 12.

To assemble the pallet 10, the deck member 14 is placed over the runners 12 so that the perforated tabs 18 extend through the slits 24 in the deck member 14 and the deck member 14 rests on the runners 12. Next, the solid tabs 19 on one side are bent backwards to allow insertion of the lateral supports 16.

The pallet has numerous advantages over the prior art. It is lightweight yet strong. It is entirely paper-based, so it can be disposed of in common paper receptacles and is completely recyclable in a paper system. It can be shipped knocked down and assembled by the user without adhesive or tape, thereby saving inbound shipping and storage space. The pallet does not rely on a glue bond or tape adhesion strength for structural integrity. The pallet may be handled with either a forklift, pallet jack or clamp truck. Once used, it may be disposed of, reused or recycled.

Other modifications and alternative embodiments of the invention are contemplated which do not depart from the scope of the invention as defined by the foregoing teachings and appended claims. It is intended that the claims cover all such modifications that fall within their scope.

What is claimed is:

1. A pallet comprising:

a plurality of elongated runners, each runner having at least one load bearing top panel and at least one perforated tab extending above the top panel, each perforated tab having at least one opening disposed therein;

a substantially flat deck member adjacent the top panels, the deck member having slits disposed therein for receiving the perforated tabs, thereby locking the runners into a fixed parallel orientation to each other; and elongate lateral supports extending through the openings in the perforated tabs to provide lateral support to the pallet.

2. The pallet of claim 1 wherein the runners include two side runners, each side runner has upwardly extending solid tabs extending above the at least one top panel, and the solid tabs abut opposing ends of the lateral supports to prevent the lateral supports from sliding out of the openings in the perforated tabs.

3. The pallet of claim 2 wherein the side runners further comprise openings cut into either end of the at least one top panel to accommodate vertical support posts.

4. The pallet of claim 2 wherein the deck member rests on the top panels between the upwardly extending solid tabs.

5. The pallet of claim 1 wherein each runner comprises a bottom panel, upwardly extending opposing side panels disposed at right angles to the bottom panel, inwardly extending load bearing top panels disposed at right angles to the side panels, and downwardly extending center mating panels disposed at right angles to the top panels, the center mating panels being in adjacent, facing relationship to each other.

6. The pallet of claim 5 wherein locking tabs extending downward from the center mating panels are inserted into slots disposed in the bottom panel to maintain the runner in a folded position.

7. The pallet of claim 1 wherein each runner further comprises flaps die cut from the bottom panel, the flaps being foldable into a vertical upstanding position, the flaps having tabs that are inserted into lateral slots in the at least one top panel to prevent trapezoiding.

8. The pallet of claim 7 wherein the runners and deck member are made of corrugated board.

9. The pallet of claim 8 wherein the flutes in the deck member run parallel to the runners.

10. The pallet of claim 1 wherein the runners, deck member and lateral supports are made of paper.

11. The pallet of claim 10 wherein the lateral supports are formed from a sheet of wound and formed laminated paper.

12. The pallet of claim 11 wherein the lateral supports have a substantially rectangular cross-sectional profile.

13. The pallet of claim 12 wherein the lateral supports have upper and lower surfaces and opposing beads integrally formed in the upper and lower surfaces.

14. The pallet of claim 11 wherein the lateral supports have a substantially circular cross-sectional profile.

15. A method of constructing a pallet comprising the steps of:

a. providing a substantially flat deck member having slits disposed therein, elongate lateral supports and a plurality of blanks, each blank having a bottom panel, two side panels connected to opposing edges of the bottom panel along fold lines, a pair of load bearing top panels connected to the side panels along parallel fold lines, a pair of center mating panels connected to the top panels along parallel fold lines, perforated tabs die cut from each top panel, locking tabs extending from both center mating panels and flaps die cut from the bottom panel;

b. folding the flaps into upright, vertical positions;

c. folding the blanks along the fold lines so that the center mating panels are brought together in adjacent, facing relationship while inserting the locking tabs into slots disposed in the bottom panel and inserting the flaps into lateral slots disposed in the top panels, thereby constructing open-ended box-like elongated runners having perforated tabs extending upward above the top panels;

d. placing the deck member over the runners so that the perforated tabs extend through the slits in the deck member; and e. inserting the lateral supports into openings in the perforated tabs to lock the components together.

* * * * *